US005652202A

United States Patent [19]

Adams

[11] Patent Number: 5,652,202

[45] Date of Patent: Jul. 29, 1997

[54] LUBRICATING OIL COMPOSITIONS

[75] Inventor: David Robert Adams, Hinton Waldrist, United Kingdom

[73] Assignee: Exxon Chemical Patents Inc., Linden, N.J.

[21] Appl. No.: 515,408

[22] Filed: Aug. 15, 1995

[51] Int. Cl.[6] ..... C10M 145/00

[52] U.S. Cl. ..... 508/232; 508/233; 508/235; 508/452; 508/475

[58] Field of Search ..... 508/232, 233, 508/235, 452, 475

[56] References Cited

U.S. PATENT DOCUMENTS

| | | | |
|---|---|---|---|
| 2,719,125 | 9/1955 | Roberts | 252/46.7 |
| 2,719,126 | 9/1955 | Fields et al. | 252/47 |
| 3,087,932 | 4/1963 | Little, Jr. | 260/302 |
| 3,087,936 | 4/1963 | LeSuer | 260/326.3 |
| 3,254,025 | 5/1966 | LeSuer | 252/32.7 |
| 3,275,554 | 9/1966 | Wagenaar | 252/50 |
| 3,442,808 | 5/1969 | Traise et al. | 252/49.6 |
| 3,565,804 | 2/1971 | Honnen | 252/50 |
| 3,821,236 | 6/1974 | Ripple | 260/302 |
| 3,904,537 | 9/1975 | Ripple | 252/47.5 |
| 4,097,387 | 6/1978 | Caspari | 252/47.5 |
| 4,102,798 | 7/1978 | Ryer et al. | 252/51.5 A |
| 4,107,059 | 8/1978 | King et al. | 252/28 |
| 4,113,639 | 9/1978 | Lonstrup et al. | 252/51.5 A |
| 4,116,876 | 9/1978 | Brois et al. | 252/49.6 |
| 4,136,043 | 1/1979 | Davis | 252/47.5 |
| 4,188,299 | 2/1980 | Caspari | 252/46.4 |
| 4,193,882 | 3/1980 | Gemmill, Jr. | 252/47.5 |
| 4,234,435 | 11/1980 | Meinhardt et al. | 252/51.5 A |
| 4,530,914 | 7/1985 | Ewen et al. | 502/113 |
| 4,665,208 | 5/1987 | Welborn, Jr. et al. | 556/179 |
| 4,702,850 | 10/1987 | Gutierrez et al. | 252/48.2 |
| 4,808,561 | 2/1989 | Welborn, Jr. | 502/104 |
| 4,857,217 | 8/1989 | Gutierrez et al. | 252/47 |
| 4,867,890 | 9/1989 | Colclough et al. | 252/327 E |
| 4,871,705 | 10/1989 | Hoel | 502/117 |
| 4,897,455 | 1/1990 | Welborn, Jr. | 526/129 |
| 4,935,576 | 6/1990 | Chen | 585/522 |
| 4,937,299 | 6/1990 | Ewen et al. | 526/119 |
| 4,938,880 | 7/1990 | Waddoups et al. | 252/32.7 E |
| 4,952,716 | 8/1990 | Lukac et al. | 556/482 |
| 4,952,739 | 8/1990 | Chen | 585/18 |
| 4,956,107 | 9/1990 | Gutierrez et al. | 252/47 |
| 4,963,275 | 10/1990 | Gutierrez et al. | 252/47 |
| 4,982,045 | 1/1991 | Chen et al. | 585/532 |
| 5,017,714 | 5/1991 | Welborn, Jr. | 556/12 |
| 5,053,152 | 10/1991 | Steckel | 252/51.5 R |
| 5,055,438 | 10/1991 | Canich | 502/117 |
| 5,057,475 | 10/1991 | Canich et al. | 502/104 |
| 5,064,802 | 11/1991 | Stevens et al. | 502/155 |
| 5,096,867 | 3/1992 | Canich | 502/103 |
| 5,120,867 | 6/1992 | Welborn, Jr. | 556/12 |
| 5,124,418 | 6/1992 | Welborn, Jr. | 556/114 |
| 5,153,157 | 10/1992 | Hlatky et al. | 502/117 |
| 5,198,401 | 3/1993 | Turner et al. | 502/155 |
| 5,227,440 | 7/1993 | Canich et al. | 526/129 |
| 5,229,032 | 7/1993 | Song et al. | 252/56 R |
| 5,241,025 | 8/1993 | Hlatky et al. | 526/129 |
| 5,266,223 | 11/1993 | Song et al. | 252/51.5 A |

FOREIGN PATENT DOCUMENTS

| | | |
|---|---|---|
| 0 208 560 | 1/1987 | European Pat. Off. . |
| 0 277 003 | 8/1988 | European Pat. Off. . |
| 0 277 004 | 8/1988 | European Pat. Off. . |
| 0 307 132 | 3/1989 | European Pat. Off. . |
| 0 330 522 | 6/1989 | European Pat. Off. . |
| 0 129 368 | 7/1989 | European Pat. Off. . |
| 0 420 436 | 4/1991 | European Pat. Off. . |
| 0 440 505 | 8/1991 | European Pat. Off. . |
| 0 520 732 | 12/1992 | European Pat. Off. . |
| 989409 | 4/1965 | United Kingdom . |
| 2001662 | 2/1979 | United Kingdom . |
| 1560830 | 2/1980 | United Kingdom . |
| 93/08221 | 4/0000 | WIPO . |
| 91/04257 | 4/1991 | WIPO . |
| 92/00333 | 1/1992 | WIPO . |
| 93/08199 | 4/1993 | WIPO . |
| 94/07928 | 4/1994 | WIPO . |
| 94/13709 | 6/1994 | WIPO . |
| 94/13715 | 6/1994 | WIPO . |
| 94/19426 | 9/1994 | WIPO . |

OTHER PUBLICATIONS

ASTM 2896–92 date unavailable.

*Primary Examiner*—Jacquieline V. Howard
*Attorney, Agent, or Firm*—Mary M. Allen; Estelle C. Bakun

[57] ABSTRACT

Copolymers and functionalised copolymers comprising ethylene units, in combination with non ethylene copolymer derivatives, give improved engine piston cleanliness when used as lubricating oil additives.

9 Claims, No Drawings

LUBRICATING OIL COMPOSITIONS

FIELD OF THE INVENTION

This invention concerns crankcase lubricating oil compositions giving improved piston cleanliness in internal combustion engines, and especially in diesel engines.

BACKGROUND OF THE INVENTION

Crankcase lubricating oils typically contain additives to enhance various aspects of oil performance. Such additives are usually mixtures of several component additives, some of which may be oil soluble polymers or derivatised polymers. Typical of such polymeric additive components are ashless dispersants and viscosity modifiers.

Ashless dispersants maintain in suspension oil insolubles resulting from oxidation of the oil during wear or combustion. They are particularly advantageous for preventing the precipitation of sludge and the formation of varnish, particularly in gasoline engines.

Ashless dispersants comprise an oil soluble polymeric hydrocarbon backbone bearing one or more functional groups that are capable of associating with particles to be dispersed. Typically, the polymer backbone is functionalised by amine, alcohol, amide, or ester polar moieties, often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene).

Viscosity modifiers (or viscosity index improvers) impart high and low temperature operability to a lubricating oil. Compounds used generally as viscosity modifiers include high molecular weight hydrocarbon polymers, including polyesters. Oil soluble viscosity modifying polymers generally have weight average molecular weights of from about 10,000 to 1,000,000, preferably 20,000 to 500,000, which may be determined by gel permeation chromatography or by light scattering.

Ashless viscosity modifiers that also function as dispersants are also known. In general, these dispersant viscosity modifiers are functionalised polymers (for example, copolymers of ethylene-propylene post grafted with an active monomer such as maleic anhydride) which are then derivatised with, for example, an alcohol or amine.

Additives comprising mixtures of ashless dispersants and viscosity modifiers are described in the art.

EP-A-307,132 discloses mixtures of two ashless dispersants each being a mono- or di-carboxylic acid-based derivative of a $C_2$ to $C_{10}$ monoolefin polymer. Mixtures of two dicarboxylic acid-based derivatives of polyisobutylene homopolymers are exemplified in Examples 6 and 7, in combination with an ethylene-propylene copolymer viscosity modifier. Improved diesel engine piston cleanliness is with these examples.

Improved ashless dispersants having enhanced sludge dispersion properties are disclosed in, for example, EP-A-440,505 and U.S. Pat. No. 5,266,223, being derived from ethylene-alpha olefin copolymers wherein at least about 30 percent of the polymer chains possess terminal vinylidene (i.e. ethenylidene) unsaturation. The combination of one specific group of improved dispersants having high number average molecular weight with other ashless dispersants such as polyalkenyl succinimides of $C_3$-$C_4$ olefins and with viscosity modifiers is disclosed in EP-A-440,505.

U.S. Pat. No. 5,266,233 describes one low number average molecular weight class of these improved dispersants wherein an ethylene-propylene copolymer is functionalised by mono- or dicarboxylic acid moieties via an 'ene' reaction or chlorination reaction. Mixtures of polyisobutene-based dispersants with 18 mole % of such improved dispersants are described as having useful viscometric properties. Such mixtures may be used with other conventional additive components, such as ethylene copolymer viscosity modifiers.

SUMMARY OF THE INVENTION

It has now surprisingly been found that copolymers and functionalised copolymers comprising ethylene units have a propensity to give rise to engine .piston deposits, especially in diesel engines. Such deposits are believed to be related to increased engine cylinder bore wear. In particular the formation of sticky deposits within the grooves of the piston which accommodate the piston rings, have been found to lead to piston ring sticking and impairment of the normal operation of the piston rings. In severe cases, piston ring sticking has been observed to lead to substantial piston ring and cylinder bore wear.

The problem of piston deposits places limitations particularly on the use of viscosity modifiers and ashless dispersants comprising ethylene copolymers, particularly in lubricating oils intended for diesel engine applications, including universal oils.

It has nevertheless surprisingly been found that copolymers and functionalised copolymers comprising ethylene units can be employed in lubricating oils which show a reduced propensity for piston deposits, by using them in combination therein with derivatives of non-ethylene copolymers, in specific relative proportions.

In the first aspect therefore, the invention provides a lubricating oil composition comprising (a) one or more additives selected from (i) oil soluble ethylene copolymers and (ii) functionalised ethylene copolymers, wherein at least one of the copolymers of (i) has greater than 30% terminal vinylidene unsaturation, or at least one of the copolymers from which the functionalised copolymers of (ii) are derived has greater than 30% terminal vinylidene unsaturation and an $\overline{M}_n$ not exceeding 4,500; and (b) one or more amide, imide, amine salt or ester derivatives of an oil soluble non-ethylene polymer, and (c) lubricating oil, characterised in that the mole ratio of (a) to (a)+(b), calculated as $$\frac{\Sigma\text{moles (a)(i)} + \Sigma\text{moles (a)(ii)}}{\Sigma\text{moles (a)(i)} + \Sigma\text{moles (a)(ii)} + \Sigma\text{moles (b)}}$$

does not exceed 0.35 and is less than 0.18 when (a) (ii) consists only of a dicarboxylic acid functionalised ethylene-propylene copolymer.

In the second aspect, the invention provides the use in a lubricating oil of an additive combination comprising (a) one or more additives selected from (i) oil soluble ethylene copolymers and (ii) functionalised ethylene copolymers, wherein at least one of the copolymers of (i) has greater than 30% terminal vinylidene unsaturation, or at least one of the copolymers from which the functionalised copolymers of (ii) are derived has greater than 30% terminal vinylidene unsaturation; and an $\overline{M}_n$ not exceeding 4,500; and (b) one or more amide, imide, amine salt or ester derivatives of an oil soluble non-ethylene polymer, wherein the mole ratio of (a), calculated as $$\frac{\Sigma\text{moles (a)(i)} + \Sigma\text{moles (a)(ii)}}{\Sigma\text{moles (a)(i)} + \Sigma\text{moles (a)(ii)} + \Sigma\text{moles (b)}}$$

does not exceed 0.35, to improve the engine piston cleanliness performance of said lubricating oil.

DETAILED DESCRIPTION

The invention will now be discussed in more detail as follows.

(A) THE OIL SOLUBLE ETHYLENE COPOLYMERS AND FUNCTIONALISED ETHYLENE COPOLYMERS

Preferably, (a) will comprise at least two ethylene copolymers, or at least two functionalised ethylene copolymers, or a mixture of at least one such copolymer with at least one such functionalised copolymer.

In both aspects of the invention, the copolymers of (a)(i) typically find application as viscosity modifiers for crankcase lubricating oils, and the functionalised copolymers of (a)(ii) as ashless dispersants. However, ethylene copolymers and functionalised copolymers may also be used to provide other performance benefits to lubricating oils; for example, some ashless dispersants may themselves have a viscosity-modifying effect.

It is preferred that (a) comprises at least one functionalised copolymer, which is preferably an ashless dispersant. In a more preferred embodiment, (a) comprises (i) an ethylene copolymer viscosity modifier and (ii) a functionalised ethylene copolymer ashless dispersant.

The copolymers and functionalised copolymers of (a) may in general comprise ethylene units and units of at least one other unsaturated monomer, which may for example be an alpha olefin or internal olefin and which may be a straight or branched aliphatic, cycloaliphatic, aromatic or alkyl aromatic olefin. Typical of such monomers are alpha olefins having a total of between 3 and 30 carbon atoms. A minor molar amount of other copolymer monomers, e.g. 1 to 10 mole %, is an α,ω-diene, such as a $C_3$ to $C_{22}$ non-conjugated diolefin (e.g. a copolymer of ethylene, propylene and 1,4-hexadiene or 5-ethylidene-2-norbornene), may be present.

One preferred class of the copolymers of (a)(i) is ethylene alpha-olefin (EAO) copolymers that may contain 1 to 50 mole % ethylene and more preferably 5 to 48 mole % ethylene and may contain more than one alpha-olefin and one or more $C_3$ to $C_{22}$ diolefins. Another preferred class is mixtures of EAO's of varying ethylene content. Different polymer types, e.g. EAO, may also be mixed or blended, as well as copolymers differing in number average molecular weight ($\overline{M}_n$). Particularly preferred copolymers are ethylene-propylene and ethylene-1-butene copolymers.

The copolymers of (a)(i) will usually have $\overline{M}_n$ within the range of from 300 to 500,000. Where such copolymers are intended to function primarily as viscosity modifiers, they desirably have $\overline{M}_n$ of 20,000 up to 500,000.

Polymer molecular weight, specifically $\overline{M}_n$ can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method, particularly for lower molecular weight polymers, is vapor pressure osmometry (see, ASTM D3592).

Where (a) does not comprise at least one functionalised copolymer (ii), at least one of the copolymers (i) has greater than 30% terminal vinylidene unsaturation.

The term alpha-olefin is used herein to refer to an olefin of the formula:

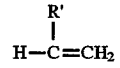

wherein R' is preferably a $C_1$- $C_{18}$ alkyl group. The requirement for terminal vinylidene unsaturation refers to the presence in the polymer of the following structure:

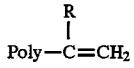

wherein Poly is the polymer chain and R is typically a $C_1$-$C_{18}$ alkyl group, typically methyl or ethyl.

A minor amount of the polymer chains can contain terminal ethenyl unsaturation, i.e. POLY—CH=$CH_2$, and a portion of the polymers can contain internal monounsaturation, e.g. POLY—CH=CH(R), where R is as defined above.

Preferably the polymers will have at least 50%, and most preferably at least 60%, of the polymer chains with terminal vinylidene unsaturation. As indicated in WO-A-94/19426, ethylene/1-butene copolymers typically have vinyl groups terminating no more than about 10 percent of the chains, and internal mono-unsaturation in the balance of the chains. The nature of the unsaturation may be determined by FTIR spectroscopic analysis, titration or C-13 NMR.

Copolymers having greater than 30% terminal vinylidene unsaturation may be prepared by various catalytic polymerization processes using metallocene catalysts which are, for example, bulky ligand transition metal compounds of the formula:

$$[L]_m M[A]_n$$

where L is a bulky ligand; A is a leaving group, M is a transition metal, and m and n are such that the total ligand valency corresponds to the transition metal valency.

Preferably the catalyst is four co-ordinate such that the compound is ionizable to a $1^+$valency state.

The ligands L and A may be bridged to each other, and if two ligands A and/or L are present, they may be bridged. The metallocene compound may be a full sandwich compound having two or more ligands, or they may be half sandwich compounds having one such ligand L. The ligand may be mono- or polynuclear or any other ligand capable of $\eta$-5 bonding to the transition metal.

One or more of the ligands may be $\pi$-bond to the transition metal atom, which may be a Group 4, 5 or 6 transition metal and/or a lathanide or actinide transition metal, with zirconium, titanium and hafnium being particularly preferred.

The ligands may be substituted or unsubstituted, and mono-, di-, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorus or nitrogen atom-containing radical, and preferably the bridge places a one atom link between the entities being bridged, although that atom may and often does carry other substituents.

The metallocene may also contain a further displaceable ligand, preferably displaced by a cocatalyst—a leaving group—that is usually selected from a wide variety of hydrocarbyl groups and halogens.

Such polymerizations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 277004, 420436, 520732;and WO-A-91/04257, 92/00333, 93/08199, 93/08221, 94/07928 and 94/13715.

Where (a) comprises one or more functionalised copolymer, (ii), these may suitably be derived from the preferred classes of copolymers previously described. It is preferred that at least one be derived from a copolymer having greater than 30% terminal vinylidene unsaturation, for example an ethylene alpha-olefin copolymer such as may be prepared using the new metallocene catalyst chemistry hereinbefore described. The $\overline{M}_n$ of at least one copolymer before functionalisation is below 4,500, preferably 500 to 4,000, and more preferably 700 to 3,500. Copolymers of both relatively low molecular weight (e.g. $\overline{M}_n$ =500 to 1500) and relatively high molecular weight (e.g. $\overline{M}_n$ =1500 to 3000) are suitable. Functionalisation may incorporate one or more functional groups into the backbone of the copolymer, or on to the copolymer as pendant groups. The functional group typically will be polar and contain one or more hetero atoms such as P, O, S, N, halogen, or boron. It can be attached to a saturated hydrocarbon part of the polymeric backbone via substitution reactions or to an olefinic portion via addition or cycloaddition reactions. Alternatively, the functional group can be incorporated into the copolymer in conjunction with oxidation or cleavage of the copolymer chain end (e.g., as in ozonolysis).

Useful functionalisation reactions include: halogenation of the copolymer at an olefinic bond and subsequent reaction of the halogenated copolymer with an ethylenically unsaturated functional compound (e.g., maleation where the copolymer is reacted with maleic acid or anhydride); reaction of the copolymer with an unsaturated functional compound by the "ene" reaction absent halogenation; reaction of the copolymer with at least one phenol group (this permits subsequent derivatisation in a Mannich base-type condensation); reaction of the copolymer at a point of unsaturation with carbon monoxide to effect carbonylation, for example via the Koch reaction; reaction of the copolymer with the functionalising compound by free radical addition using a free radical catalyst; reaction with a thiocarboxylic acid derivative; and reaction of the copolymer by air oxidation methods, epoxidation, chloroamination, or ozonolysis.

In one preferred reaction, functionalisation is achieved via the Koch Reaction, which favours the formation of derivatised copolymers wherein the resulting monocarboxylic acid moieties are found predominantly at tertiary carbons along the copolymer chain, due to the selectivity for the 'neo' reaction product. The Koch reaction is described in WO 94/13709, to which further attention is directed.

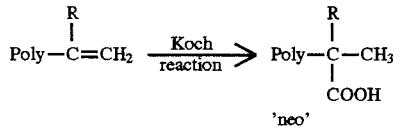

The functionalised copolymer prepared as described may then be reacted with a nucleophilic reactant such as an amine, amino-alcohol, hydroxy-compound, metal compound or mixture thereof to form the corresponding product. Within this specification, the term 'functionalised ethylene copolymers' also refers to the products of these reactions.

Useful amines for such reactions comprise at least one amine functional group and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and -polypropyleneamines such as 1,2-propylene diamine; and di-(1,2propylene)triamine.

Other useful amine compounds for such reactions include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The reaction with the amine compound may be performed according to conventional techniques, as described in EP-A 208,560; U.S. Pat. No. 4,234,435 and U.S. Pat. No. 5,229,022.

Hydroxy compounds such as monohydric and polyhydric alcohols, or aromatic compounds such as phenols and naphthols, are also useful for such reactions. Polyhydric alcohols are preferred, e.g., alkylene glycols in which the alkylene radical contains from 2 to 8 carbon atoms. Other useful polyhydric alcohols include glycerol, mono-oleate of glycerol, monostearate of glycerol, monomethyl ether of glycerol, pentaerythritol, dipentaerythritol, and mixtures thereof; also unsaturated alcohols such as allyl alcohol, cinnamyl alcohol, propargyl alcohol, 1-cyclohexane-3-ol, and oleyl alcohol. Still other suitable classes of alcohols comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms.

Alternative functionalised ethylene copolymers (a)(ii) are those wherein a polyamine is attached directly to the polymer backbone by the methods shown in U.S. Pat. Nos. 3,275,554 and 3,656,804 where a halogen group on a halogenated hydrocarbon is displaced with various alkylene polyamines.

Another class of functionalished ethylene copolymers useful in both aspects of the invention comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a copolymer product of a metallocene-catalysed polymerisation as a substituent on the benzene group or may be reacted with a compound containing such a copolymer substituted on a succinic anhydride, in a manner similar to that shown in U.S. Pat. No. 3,443,808.

A preferred group of functionalised ethylene copolymers includes those functionalised with succinic anhydride groups and then reacted with polyethylene amines (e.g. tetraethylene pentamine) or aminoalcohols such as trimethylolaminomethane, and optionally additional reactants such as alcohols and reactive metals (e.g. pentaerythritol, and combinations thereof).

Examples of functionalised ethylene copolymers based on copolymers synthesized using metallocene catalyst systems are described in publications identified above.

The functionalised ethylene copolymers of both aspects of the invention, and particularly those being ashless dispersants, can be further post-treated by a variety of conventional post treatments such as boration, as generally taught in U.S. Pat. Nos. 3,087,936 and 3,254,025. This is readily accomplished by treating an acyl nitrogen-containing derivative with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the derivatives contain from about 0.05 to 2.0 wt. %, e.g. 0.05 to 0.7 wt. % boron based on the total weight of the borated acyl nitrogen compound. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the carboxylic acid material and amine while removing water.

Where (a) comprises a mixture of at least one copolymer (i) with at least one copolymer (ii), the ratio of (i): (ii) will be determined by such factors as choice and economics. However, suitable proportions range between 1:20 and 20:1 on a wt:wt (active ingredient) basis, and preferably between 1:10 and 2:1, more preferably 1:8 and 1:1.

(B) ONE OR MORE AMIDE, IMIDE, AMINE SALT OR ESTER DERIVATIVES OF AN OIL SOLUBLE NON-ETHYLENE POLYMER

The non-ethylene polymer of (b) is typically a homopolymer such as polypropylene, polybutene, or preferably polyisobutylene, or a copolymer such as propylene-butene or butene-isobutylene, prepared by conventional cationic polymerisation in the presence of a Lewis acid catalyst and, optionally, a catalytic promoter, for example, an organoaluminum catalyst such as ethylaluminum dichloride and an optional promoter such as HCl. Most commonly, polyisobutylene polymers are derived from Raffinate I refinery feedstreams. Various reactor configurations can be utilised, for example, tubular or stirred tank reactors, as well as fixed bed catalyst systems in addition to homogeneous catalysts. Such polymerization processes and catalysts are described, e.g., in U.S. Pat. Nos. 4,935,576; 4,952,739; 4,982,045; and UK-A 2,001,662.

The required derivatives of such polymers may be obtained using those reactions hereinbefore described for the functionalisation of the ethylene copolymers of (a).

Preferably, the non-ethylene copolymer of (b) is functionalised with a dicarboxylic acid moiety to form an alkyl- or alkenyl-substituted dicarboxylic acid, which is thereafter reacted with the nucleophilic reagent appropriate for forming the desired derivative.

A preferred group of derivatives includes those derived from polyisobutylene substituted succinic anhydride groups reacted with polyalkylene and polyoxyalkylene poly-amines (e.g., tetraethylene pentamine, pentaethylene hexamine, polyoxypropylene diamine), aminoalcohols such as trismethylolaminomethane and optionally additional reactants such as alcohols and reactive metals (e.g. pentaerythritol, and combinations thereof).

Most preferred derivatives are those comprising the amide, imide or mixtures thereof, of a polyalkylene or polyoxyalkylene polyamine having between 2 and 10, preferably 4 and 8 and most preferably 5 and 7 nitrogen atoms.

The derivatives can be further post-treated by a variety of conventional post treatments such as boration, as described above in (a).

THE RELATIVE PROPORTIONS OF (A) AND (B):

According to both aspects of the invention, the mole ratio of (a) to (a) +(b) calculated as $$\frac{\Sigma\text{moles (a)(i)} + \Sigma\text{moles (a)(ii)}}{\Sigma\text{moles (a)(i)} + \Sigma\text{moles (a)(ii)} + \Sigma\text{moles (b)}}$$

should not exceed 0.35. Preferably, this value lies between 0.01 and 0.25 and more preferably between 0.02 and 0.20. Most preferably, this value is between 0.04 and 0.16. Values less than 0.18 are advantageous.

It has been found that when (a) and (b) are present in these relative proportions, the engine pistons remain surprisingly clean.

The lubricating oil composition of the first aspect of the invention will typically contain a total amount of (a)+(b) of from 0.1 to 20, preferably 1–8 and more preferably 3–6 mass % (active ingredient).

THE LUBRICATING OIL

The lubricating oil may be selected from any of the synthetic or natural oils used as crankcase lubricating oils for spark-ignited and compression-ignited engines. The lubricating oil base stock conveniently has a viscosity of about 2.5 to about 12 cSt or $mm^2/s$ and preferably about 2.5 to about 9 cSt or $mm^2/s$ at 100° C. Mixtures of synthetic and natural base oils may be used if desired.

OTHER ADDITIVES

The lubricating oil composition of the first aspect of the invention, and the lubricating oil of the second aspect of the invention, may additionally contain one or more other component additives typically used in lubricating oils to advantageous effect. Examples include other viscosity modifiers, metal or ash-containing detergents, antioxidants, anti-wear agents, friction modifiers, rust inhibitors, anti-foaming agents, demulsifiers and pour point depressants, such as are described below.

(i) Viscosity Modifiers

The lubricant may be formulated with or without other conventional viscosity modifiers, or other dispersant viscosity modifiers, not falling within a(i) or a(ii).

Representative examples of other suitable viscosity modifiers are polyisobutylene, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Such viscosity modifiers will be used in an amount to give the required viscosity characteristics. Since they are typically used in the form of oil solutions the amount of additive employed will depend on the concentration of polymer in the oil solution comprising the additive. However by way of illustration, typical oil solutions of polymer used as VMs are used in amount of from 1 to 30% of the blended oil. The amount of VM as active ingredient of the oil is generally from 0.01 to 6 wt %, and more preferably from 0.1 to 2 wt %.

(ii) Metal-Containing Detergents

Metal-containing or ash-forming detergents function both as detergents to reduce or remove deposits and as acid neutralisers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts of from 0 to 80. It is possible to include large amounts of a metal base by reacting an excess of a metal compound such as an oxide or hydroxide with an acidic gas such as carbon dioxide. The resulting overbased detergent comprises neutralised detergent as the outer layer of a metal base (e.g. carbonate) micelle. Such overbased detergents may have a TBN (as may be measured by ASTM D2896) of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralised with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %).

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

(iii) Metal Dihydrocarbyl Dithiophosphates

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralising the formed DDPA with a zinc compound. The zinc dihydrocarbyl dithiophosphates can be made from mixed DDPA which in turn may be made from mixed alcohols. Alternatively, multiple zinc dihydrocarbyl dithiophosphates can be made and subsequently mixed.

Thus the dithiophosphoric acid containing secondary hydrocarbyl groups used in this invention may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates useful in the present invention are oil soluble salts of dihydrocarbyl dithiophosphoric acids and may be represented by the following formula:

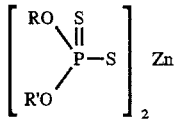

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. At least 50 (mole) % of the alcohols used to introduce hydrocarbyl groups into the dithiophosphoric acids are secondary alcohols.

(iv) Antioxidants

Oxidation inhibitors or antioxidants reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines. The aromatic rings are typically substituted by one or more substituents selected from alkyl, cycloalkyl, alkoxy, aryloxy, acyl, acylamino, hydroxy, and nitro groups.

(v) Other Additives

Friction modifiers may be included to improve fuel economy. Oil-soluble alkoxylated mono- and diamines are well known to improve boundary layer lubrication. The amines may be used as such or in the form of an adduct or reaction product with a boron compound such as boric oxide, boron halide, metaborate, boric acid or a mono-, di- or trialkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

When lubricating oils contain one or more of the above-mentioned component additives in addition to additives (a) and (b), each component additive is typically blended into the base oil in an amount which enables it to provide its desired function. Representative effective amounts of such additives, when used in crankcase lubricants, are listed below. All the values listed are stated as mass percent active ingredient.

| COMPONENT ADDITIVE | MASS % (Broad) | MASS % (Preferred) |
|---|---|---|
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Anti-oxidant | 0–5 | 0.01–1.5 |
| Pour Point Depressant | 0.01–5 | 0.01–1.5 |
| Anti-Foaming Agent | 0–5 | 0.001–0.15 |
| Anti-wear Agents | 0–0.5 | 0–0.2 |
| Friction Modifier | 0–5 | 0–1.5 |
| Viscosity Modifier | 0.01–6 | 0–4 |
| Mineral or Synthetic Base Oil | Balance | Balance |

1. In multi-graded oils.

The components may be incorporated into a lubricating oil in any convenient way. Thus, each can be added directly to the oil by dispersing or dissolving it in the oil at the desired level of concentration. Such blending may occur at ambient temperature or at an elevated temperature.

Preferably all the co-components except for the viscosity modifier and the pour point depressant are blended into the additive composition of the first aspect of the invention, which is subsequently blended into base lubricating oil to make finished lubricant. The additive composition may take the form of a concentrate, the use of which is conventional. The concentrate will typically be formulated to contain the additive(s) in proper amounts to provide the desired concentration in the final formulation when the concentrate is combined with a predetermined amount of base lubricant.

Preferably the concentrate is made in accordance with the method described in U.S. Pat. No. 4,938,880. That patent describes making a premix of ashless dispersants and metal detergents that is pre-blended at a temperature of at least about 100° C. Thereafter the pre-mix is cooled to at least 85° C. and the remaining co-components added.

The final formulations may employ from 2 to 15 mass % and preferably 5 to 10 mass %, typically about 7 to 8 mass % of the concentrate or additive composition with the remainder being base lubricating oil.

The invention will now be described by way of illustration only with reference to the following examples. In the examples, unless otherwise noted, all treat rates of all additives are reported as weight percent active ingredient in the treated oils.

EXAMPLE 1

The series of lubricating oil compositions defined in Table 1 were each tested for diesel engine piston cleanliness performance in a Volkswagen 1.6 liter Intercooled Turbocharged diesel engine, run according to the industry standard CEC L-46-T-93 procedure. New pistons were used at the start of each test and the general piston cleanliness following each test rated visually according to standard procedure DIN 51 361, part 2 and recorded as 'piston merits' on a numerical scale of from 0 to 100, with a higher numerical value corresponding to a lower level of piston deposits. The piston ring sticking tendency of each oil composition was also measured during this test according to standard CEC procedure M-02-A-78, and recorded according to the following numerical scale.

| |
|---|
| Free Ring (No Ring Sticking) = 0 |
| Sluggish Ring = 1 |
| Point Nipped Ring = 2.5 |
| Polished Stuck Ring = 5 |
| Dark Struck Ring = 10 |

The test is typically used as a "pass/fail" performance test, whereby a lubricating oil composition must achieve at least 70 piston merits and zero ring sticking to be considered a "pass" for diesel piston cleanliness.

Additives Used in Example 1:

EBCO-PAM1 was a monocarboxylic acid-based derivative of a 3250 number average molecular weight ethylene-1-butene copolymer containing 46 mole % ethylene and having 66% terminal vinylidene unsaturation, having been made using a metallocene/alumoxane catalyst as hereinbefore described. The polymer was functionalised by introduction of a carboxylic group via the Koch reaction, and subsequent reaction with a polyamine and boration.

EBCO-PAM2 was a similar dispersant, except that the ethylene-1-butene copolymer contained 51 mole % ethylene and had a number average molecular weight of 4700 and 64% terminal vinylidene unsaturation.

EP1 was a conventional ethylene-propylene copolymer viscosity modifier having a number-average molecular weight of 50,000 and less than 30% terminal vinylidene unsaturation.

PIBSA-PAM1 was a derivative of a non-ethylene polymer, being a conventional borated polyisobutenylsuccinimide dispersant formed by reacting a polyisobutylene of number average molecular weight of 950 (target value) and a polyalkylene polyamine.

Each lubricating oil composition in Table I comprised a major proportion of base lubricating oil, and the quantity of viscosity modifier (EP1) required to impart 15W40 multigrade performance. In addition to the additives outlined in Table 1, each lubricating oil composition also comprised a proprietary additive package comprising antioxidant, compatability aid, antiwear, friction modifier, antifoam and detergent additives.

Results of Example 1

The piston merit and ring sticking performance of the oils of Example 1 is also shown in Table 1.

Only lubricating oil compositions in accordance with the present invention gave an overall pass in the engine test.

TABLE 1

| | Lubricating Oil Compositions | | | | | | |
|---|---|---|---|---|---|---|---|
| | (a); treat rate in lubricant (mass % a.i.) | | | | | | |
| Test No. | (i) Ethylene copolymer | (ii) Functionalised ethylene copolymer | (b) Non-ethylene copolymer; treat rate in lubricant (mass % a.i.) | Mole ratio of (a) to (a) + (b) | Ring sticking | Piston Merits | Pass/ Fail |
| 1 | EP 1; 0.6 | EBCO-PAM 1; 3. | — | 1.0 | 0 | 69 | FAIL |
| 2 | EP 1; 0.63 | EBCO-PAM 1; 2.0 | PIBSA-PAM 1; 1.1 | 0.40 | 5 | 73 | FAIL |
| 3 | EP 1; 0.75 | EBCO-PAM 1; 1.0 | PIBSA-PAM 1; 2.1 | 0.15 | 0 | 75 | PASS |
| 4 | EP 1; 0.8 | EBCO-PAM 1; 0.5 | PIBSA-PAM 1; 3.15 | 0.06 | 0 | 72 | PASS |
| 5 | EP 1; 0.8 | — | PIBSA-PAM 1; 4.2 | 0.005 | 1 | 75 | FAIL |
| 6 | EP 1; 0.55 | EBCO-PAM 2; 1.5 | PIBSA-PAM 1; 2.1 | 0.16 | 5 | 72 | FAIL |
| 7 | EP 1; 0.65 | EBCO-PAM 2; 0.9 | PIBSA-PAM 1; 1.05 | 0.19 | 0 | 69 | FAIL |

I claim:

1. A lubricating oil composition that does not induce formation of significant sticky piston deposits, said oil comprising:

(a) one or more additives selected from (i) oil soluble ethylene copolymers and (ii) functionalised ethylene copolymers, wherein at least one of the copolymers of (i) has greater than 30% terminal vinylidene unsaturation, or at least one of the copolymers from which the functionalised copolymers of (ii) are derived has greater than 30% terminal vinylidene unsaturation and an $\overline{M}_n$ not exceeding 4,500;

(b) one or more amide, imide, amine salt or ester derivatives of an oil soluble non-ethylene polymer, and (c) lubricating oil, characterised in that the mole ratio of (a) to (a)+(b), calculated as $$\frac{\Sigma\text{moles (a)(i)} + \Sigma\text{moles (a)(ii)}}{\Sigma\text{moles (a)(i)} + \Sigma\text{moles (a)(ii)} + \Sigma\text{moles (b)}}$$

does not exceed 0.35 and is less than 0.18 when (a)(ii) consists only of a dicarboxylic acid functionalised ethylene-propylene copolymer.

2. The composition of claim 1 wherein (a)(ii) comprises at least one ashless dispersant.

3. The composition of claim 2 wherein at least one ashless dispersant is derived from an ethylene alpha-olefin copolymer having greater than 30% terminal vinylidene unsaturation.

4. The composition of claim 3 wherein the ethylene alpha-olefin copolymer is an ethylene-propylene or ethylene-1-butene copolymer.

5. The composition of claims 2, 3, or 4 wherein at least one ashless dispersant has a number-average molecular weight of between 700 and 5,000.

6. The composition of claims 2, 3, or 4 wherein (b) comprises an ashless dispersant derived from a polyisobutylene succinic acid and a polyalkylene or polyoxyalkylene polyamine.

7. The composition of claims 2, 3, or 4 wherein the mole ratio of (a) to (a)+(b) is less than 0.18.

8. The composition of claims 2, 3, or 4 wherein the total amount of (a)+(b) in the lubricating oil is from 1 to 8 mass % (active ingredient).

9. The composition of claim 1, wherein said composition is a diesel lubricating oil composition having piston merits of at least 70 and ring sticking of essentially zero.

* * * * *